US010437195B2

(12) United States Patent
Maeda et al.

(10) Patent No.: US 10,437,195 B2
(45) Date of Patent: Oct. 8, 2019

(54) IMAGE FORMING APPARATUS HAVING A HEATER THAT GENERATES HEAT USING ALTERNATING CURRENT VOLTAGE AND A HEATER THAT GENERATES HEAT USING A DIRECT CURRENT VOLTAGE

(71) Applicant: CANON KABUSHIKI KAISHA, Tokyo (JP)

(72) Inventors: Yoritsugu Maeda, Moriya (JP); Eijiro Atarashi, Tokyo (JP); Kazuhisa Koizumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/757,783

(22) PCT Filed: Jul. 26, 2016

(86) PCT No.: PCT/JP2016/003459
§ 371 (c)(1),
(2) Date: Mar. 6, 2018

(87) PCT Pub. No.: WO2017/043005
PCT Pub. Date: Mar. 16, 2017

(65) Prior Publication Data

US 2019/0121289 A1 Apr. 25, 2019

(30) Foreign Application Priority Data

Sep. 7, 2015 (JP) ..... 2015-176168

(51) Int. Cl.
*G03G 15/00* (2006.01)
*G03G 21/20* (2006.01)
*B41J 29/38* (2006.01)

(52) U.S. Cl.
CPC ..... *G03G 21/20* (2013.01); *B41J 29/38* (2013.01); *G03G 15/6502* (2013.01); *G03G 15/6508* (2013.01); *G03G 15/75* (2013.01)

(58) Field of Classification Search
CPC ..... G03G 15/6502; G03G 21/20
(Continued)

(56) References Cited

U.S. PATENT DOCUMENTS 5,325,209 A 6/1994 Manabe
7,542,691 B2 6/2009 Yoda
(Continued)

FOREIGN PATENT DOCUMENTS

JP H04-318749 A 11/1992
JP 2003-084629 A 3/2003
(Continued)

OTHER PUBLICATIONS

International Search Report and Written Opinion dated Jul. 26, 2016, issued in corresponding International Application No. PCT/JP2016/003459.

*Primary Examiner* — William J Royer
(74) *Attorney, Agent, or Firm* — Venable LLP

(57) ABSTRACT

An image forming apparatus includes a sheet feeding cassette configured to store a recording sheet, a conveyance unit configured to convey the recording sheet stored in the sheet feeding cassette, and an image forming unit configured to form an image on a photo sensitive member, and to transfer the image onto the recording sheet conveyed by the conveyance unit. A power supply unit is configured to convert an alternating current (AC) voltage of a commercial power supply into a direct current (DC) voltage, and is configured to supply the AC voltage and the DC voltage. A first heater heats the sheet feeding cassette, and generates heat with the AC voltage supplied by the commercial power supply, and
(Continued)

a second heater heats the photosensitive member of the image forming unit, and generates heat with the DC voltage supplied by the power supply unit.

18 Claims, 8 Drawing Sheets

(58) Field of Classification Search
USPC ..... 399/94, 96, 390
See application file for complete search history.

(56) References Cited

U.S. PATENT DOCUMENTS

| | | | | |
|---|---|---|---|---|
| 7,668,497 | B2 | 2/2010 | Maeda et al. | |
| 9,946,214 | B2 * | 4/2018 | Kinoshita | G03G 21/20 |
| 9,946,215 | B2 | 4/2018 | Koizumi et al. | |

FOREIGN PATENT DOCUMENTS

| | | | |
|---|---|---|---|
| JP | 2006-276431 | A | 10/2006 |
| JP | 2006-284618 | A | 10/2006 |
| JP | 2009-216827 | A | 9/2009 |

* cited by examiner

IMAGE FORMING APPARATUS HAVING A HEATER THAT GENERATES HEAT USING ALTERNATING CURRENT VOLTAGE AND A HEATER THAT GENERATES HEAT USING A DIRECT CURRENT VOLTAGE

This application is a U.S. National Stage application of International Application No. PCT/JP2016/003459, filed Jul. 26, 2016, which claims the benefit of Japanese Patent Application No. 2015-176168, filed on Sep. 7, 2015, which are hereby incorporated by reference herein in their entireties.

TECHNICAL FIELD

The present invention relates to an image forming apparatus including an environment heater.

BACKGROUND ART

In an image forming apparatus, it is required to prevent dew condensation and operation failures due to environmental variations, e.g., a rapid room-temperature change. In the following, the image forming apparatus is mainly described as an example. The above-mentioned rapid temperature change is caused depending on a season and a region in which the image forming apparatus is installed, and is further caused depending on environmental variations, e.g., a rapid room-temperature change due to coldness at night or in the morning, or air conditioning after the beginning of work in a company. Such a rapid temperature change may inhibit satisfactory image formation.

In order to prevent dew condensation, there is known a method of preventing the dew condensation by adding, after the image forming apparatus is installed, an environment heater to the image forming apparatus in accordance with the usage environment.

In recent years, the image forming apparatus is required to have more stable image quality and longer life. In order to satisfy those requirements, it is necessary to further stabilize, in an electrophotographic process, the temperature of the image forming apparatus, and, in particular, the temperature of a part around a photosensitive drum. Further, also in a general information processing apparatus, for longer life, and the like, it is required to stabilize the temperature at a specific unit of the information processing apparatus.

As the environment heater, there is known an alternating current (AC) heater configured to use, as a power supply, an AC commercial power supply to which the image forming apparatus is connected.

In Japanese Patent Application Laid-Open No. 2009-216827, there is described an environment heater to be selectively mounted to an apparatus main body depending on the voltage of the commercial power supply to be used.

Technical Problem

In the heater configured to use the AC commercial power supply, however, the amount of heat generation is increased as the supplied voltage is increased. Therefore, when the AC voltage supplied to the image forming apparatus varies, the amount of heat generated by the AC heater in accordance therewith also varies.

When the voltage of the commercial power supply varies depending on the region in which the image forming apparatus is installed, the amount of heat generated by the AC heater also varies, and hence, it is difficult to maintain the temperature constant with the AC heater. In view of this, there has been proposed usage of a direct current (DC) heater configured to use DC power obtained by subjecting the AC commercial power to alternating current/direct current (AC/DC) conversion. The DC heater is used as a heater configured to maintain the temperature constant (hereafter referred to as "environment heater").

In particular, in an image forming apparatus having an energy saving mode, power is also required to be fed to a control unit configured to control the state of the energy saving mode. In order to feed power to such a control unit, there is provided a control circuit DC power supply configured to output DC power from the AC commercial power supply connected to the image forming apparatus.

Therefore, there have been proposed usage of the DC heater as the environment heater as described above, and also usage of the above-mentioned control circuit DC power supply as a power supply of the environment heater.

When the DC heater is simply connected in parallel to the control circuit power supply as the environment heater, however, apart from the energy saving mode in which the environment heater is not driven, the power consumption of the control unit is increased in a standby or an image forming mode.

Therefore, as the DC power supply, it is necessary to employ a control circuit power supply of a high-output type, which is capable of responding to power increase due to the power consumption of the control unit and the power consumption of the DC heater. In such a case, however, there arises a problem in that power of the image forming apparatus during the energy saving mode is increased.

From the viewpoint of suppressing the increase in maximum power output of the control circuit power supply, it is preferred to reduce the number of portions to mount the DC heaters. An image reading unit, a sheet feeding cassette unit, and an image forming unit to which the DC heaters are mounted are respectively arranged at independent portions, however, and hence, it is difficult to simply reduce the number of portions to mount the DC heaters.

Therefore, the present invention has an object to perform temperature control by providing a DC heater in an information processing apparatus, e.g., an image forming apparatus, and to suppress DC power consumption in the information processing apparatus.

SUMMARY OF INVENTION

According to one aspect, the present invention provides an image forming apparatus comprising a sheet feeding cassette configured to store a recording sheet, a conveyance unit configured to convey the recording sheet stored in the sheet feeding cassette, an image forming unit configured to form an image formed on a photosensitive member onto the recording sheet conveyed by the conveyance unit, a power supply unit configured to convert an alternating current (AC) voltage of a commercial power supply into a direct current (DC) voltage, a first heater configured to heat the sheet feeding cassette, and to generate heat with the AC voltage of the commercial power supply, and a second heater configured to heat the photosensitive member of the image forming unit, and to generate heat with the DC voltage of the power supply unit.

Advantageous Effects of Invention

According to the present invention, the temperature control is performed by providing the DC heater in the information processing apparatus, e.g., the image forming apparatus, and the DC power consumption in the information processing apparatus is suppressed.

DESCRIPTION OF EMBODIMENTS

Figure 1A:
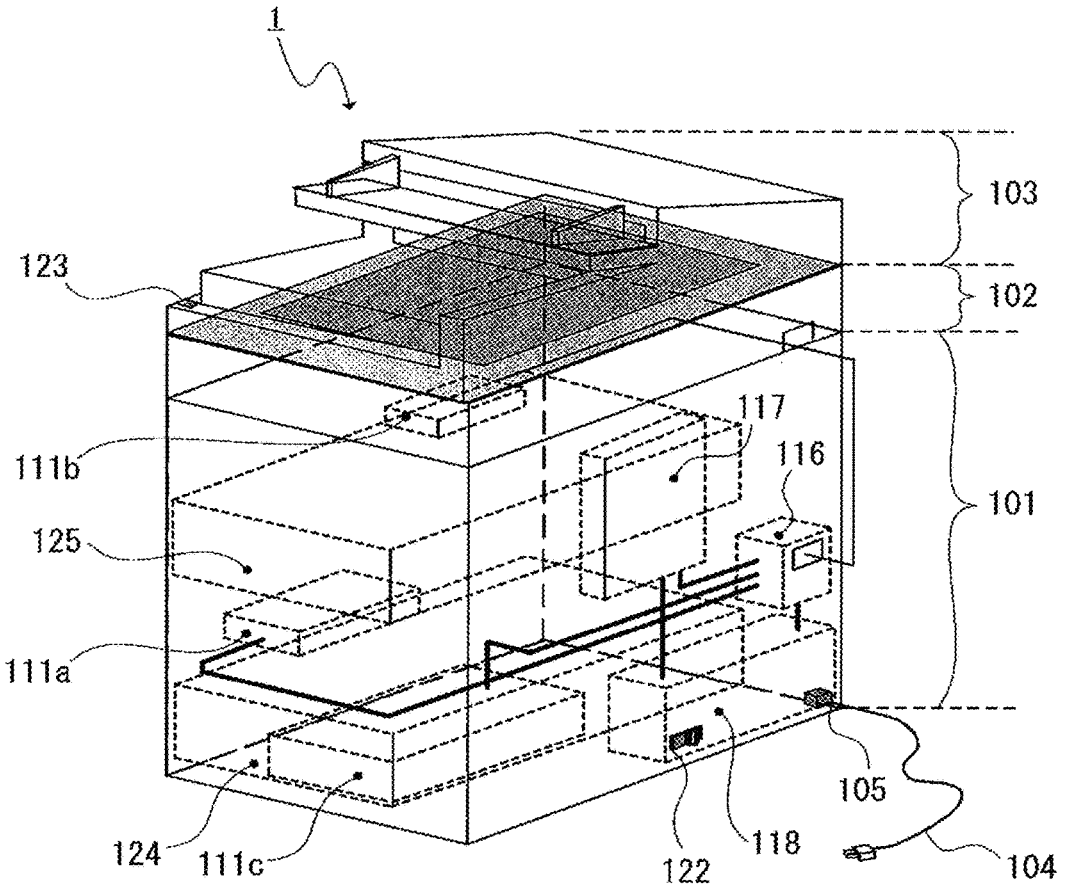
FIG. 1A is a partially transparent perspective view of an image forming apparatus.
Figure 1B:
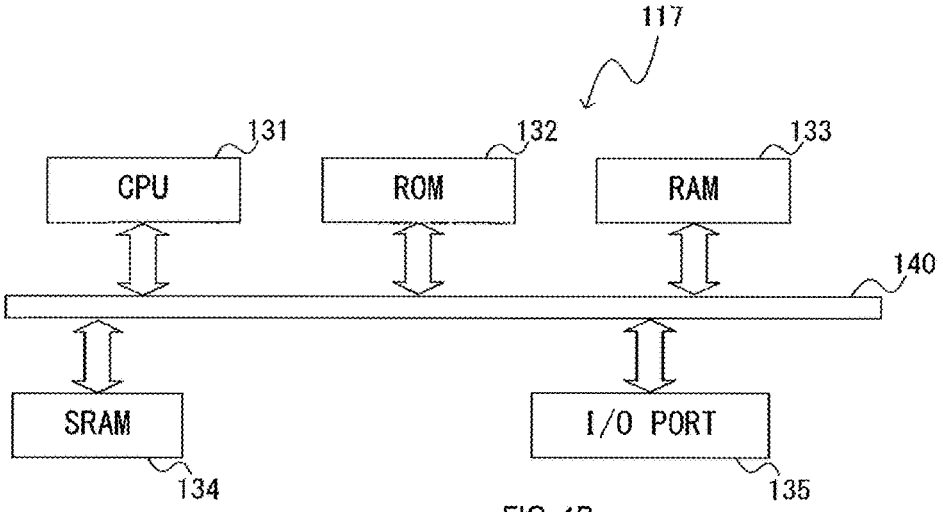
FIG. 1B is a functional block diagram of a system controller.
Figure 2:
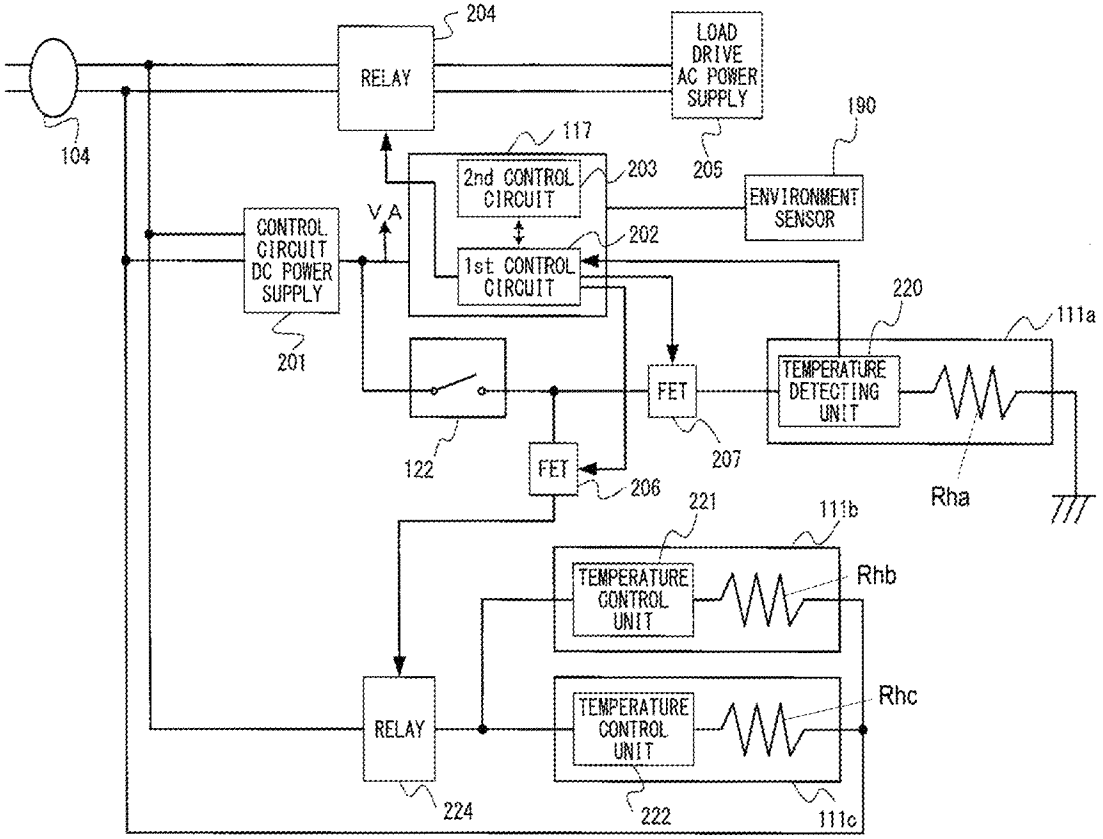
FIG. 2 is a control block diagram of the image forming apparatus.

Now, an image forming apparatus according to a first embodiment of the present invention is described with reference to the drawings. FIG. 1A is a partially transparent perspective view of an image forming apparatus 1 as viewed obliquely from a back surface side, and FIG. 1B is a functional block diagram of a system controller 117 provided in the image forming apparatus 1. Further, FIG. 2 is a control block diagram of the image forming apparatus 1.

As illustrated in FIG. 1A, the image forming apparatus 1 includes three parts, specifically, an image engine unit 101, an image reading unit 102, and an original feeding unit 103.

An alternating current (AC) cord 104 is connected to an AC commercial power supply, and has a plug shape that differs depending on the region in which the image forming apparatus 1 is installed. AC commercial power is fed to the apparatus via the AC cord 104 and an inlet 105.

A main body power supply 118 includes a control circuit direct current (DC) power supply 201 and a load drive AC power supply 205.

In order to simplify the drawings, the control circuit DC power supply 201 and the load drive AC power supply 205 are illustrated only in FIG. 2, and are not illustrated in FIG. 1A. Details of the main body power supply 118 are described later with reference to FIG. 2.

The control circuit DC power supply 201 is driven by the AC power output from the AC commercial power supply to output DC power. This DC power is supplied to drive loads, such as the system controller 117 and a motor or a solenoid (not shown), via a relay board 116 serving as a power distributing unit.

The image forming apparatus 1 of this embodiment is configured to be capable of shifting to an energy saving mode from a normal power mode to be described later. In FIG. 1A, a mode switching switch 123 is a switch configured to receive, through a manual operation by a user, a requirement of shifting to the energy saving mode, in which power consumption is suppressed, and a requirement of returning from the energy saving mode. When the user depresses the mode switching switch 123, the power mode of the image forming apparatus 1 can be switched. In the following, the energy saving mode is sometimes referred to as "first mode", and a normal power mode, which is a mode other than the energy saving mode, e.g., a standby mode or an image forming mode, is sometimes referred to as "second mode". The normal power mode is a power mode at the time of a standby mode for waiting for the start of the image formation, and an image forming operation mode for forming an image. The normal power mode is greater in power consumption than the energy saving mode. When the mode switching switch 123 is depressed, as described later, a central processing unit 131 operates in the energy saving mode.

In FIG. 1A and FIG. 2, heaters 111*a*, 111*b*, and 111*c* are resistors having predetermined resistance values Rha, Rhb, and Rhc, respectively. The amount of heat generation (power consumption) of each of the heaters 111*a*, 111*b*, and 111*c* is determined based on the supplied voltage. Further, a field-effect transistor (hereafter referred to as "FET") 206 operates as first cut-off means for cutting off power to be fed to the heaters 111*b* and 111*c*. An FET 207 operates as second cut-off means for cutting off power to be fed to the heater 111*a*. That is, the FETs 206 and 207 are switches to be turned on and off by signals.

In this embodiment, the heater 111*a* is arranged on a photosensitive drum of an image forming unit 125, the heater 111*b* is arranged inside the image reading unit 102, and the heater 111*c* is arranged in a sheet feeding cassette 124 configured to store recording sheets. The image forming unit 125 is configured to develop an electrostatic latent image formed on the photosensitive drum to form a toner image, and to transfer the toner image onto a recording sheet fed from the sheet feeding cassette 124 and conveyed by a conveyance unit (not shown) to perform recording. When an environment switch 122, which is manually switched by the user, is in an ON state, power can be fed to the heaters 111*a* to 111*c* arranged in those units. Further, when the environment switch 122 is in an OFF state, the FETs 206 and 207 for feeding power to those heaters are turned off, and hence, power cannot be fed to the heaters 111*a* to 111*c*.

As illustrated in FIG. 1B, the system controller 117 includes the CPU 131, a read only memory (ROM) 132 in which control programs are written, and a random access memory (RAM) 133 for use to perform processing. The system controller 117 further includes an static RAM (SRAM) and an input/output (I/O) port 135. The SRAM 134 is a non-volatile memory configured to keep the recording content even when the power of the image forming apparatus 1 is turned off. The CPU 131, the ROM 132, the RAM 133, the SRAM 134, and the I/O port 135 are connected to each other via a bus 140. The system controller 117 is configured to control a first control circuit 202 and a second control circuit 203 illustrated in FIG. 2, via the CPU 131.

Further, the system controller 117 is configured to control the load drive AC power supply 205 such that the load drive AC power supply 205 does not operate during the energy saving mode, but operates during other modes. Meanwhile, the system controller 117 is configured to control the control circuit DC power supply 201 such that the control circuit DC power supply 201 operates during any of the energy saving mode and other modes.

The I/O port 135 is connected to drive loads, such as a motor and a solenoid configured to operate the photosensitive drum and a developing unit of the image forming unit 125 illustrated in FIG. 1A, a sensor configured to detect the position of the sheet, a fixing device, and the like. Further, the I/O port 135 is connected to an environment sensor 190 configured to detect a temperature and a humidity of an environment in which the image forming apparatus 1 is installed. The CPU 131 is configured to sequentially perform control of input/output via the I/O port 135 in accordance with the content of the ROM 132, to thereby execute the image forming operation.

As illustrated in FIG. 2, when the plug of the main body power supply AC cord 104 is connected to a commercial outlet, power is supplied to the control circuit DC power supply 201 connected to the system controller 117. Further, the main body power supply AC cord 104 is configured to supply power to the load drive AC power supply 205 via a relay 204.

The control circuit DC power supply 201 is connected to the environment switch 122, the FET 206, and a relay 224. That is, the environment switch 122 is arranged on a DC power supply line between the control circuit DC power supply 201 and the heater 111*a*. The relay 224 is connected to a temperature control unit 221 of the heater 111*b* and a temperature control unit 222 of the heater 111*c*.

As illustrated in FIG. 2, the system controller 117 includes the first control circuit 202 and the second control circuit 203. The first control circuit 202 is configured to acquire the temperature from a temperature detecting unit 220 of the heater 111*a*, and to control the temperature of the heater 111*a* via the FET 207. The second control circuit is configured to control the drive loads, such as the motor and the solenoid configured to operate the photosensitive drum and the developing unit of the image forming unit 125 connected to the load drive AC power supply 205.

Figure 3:
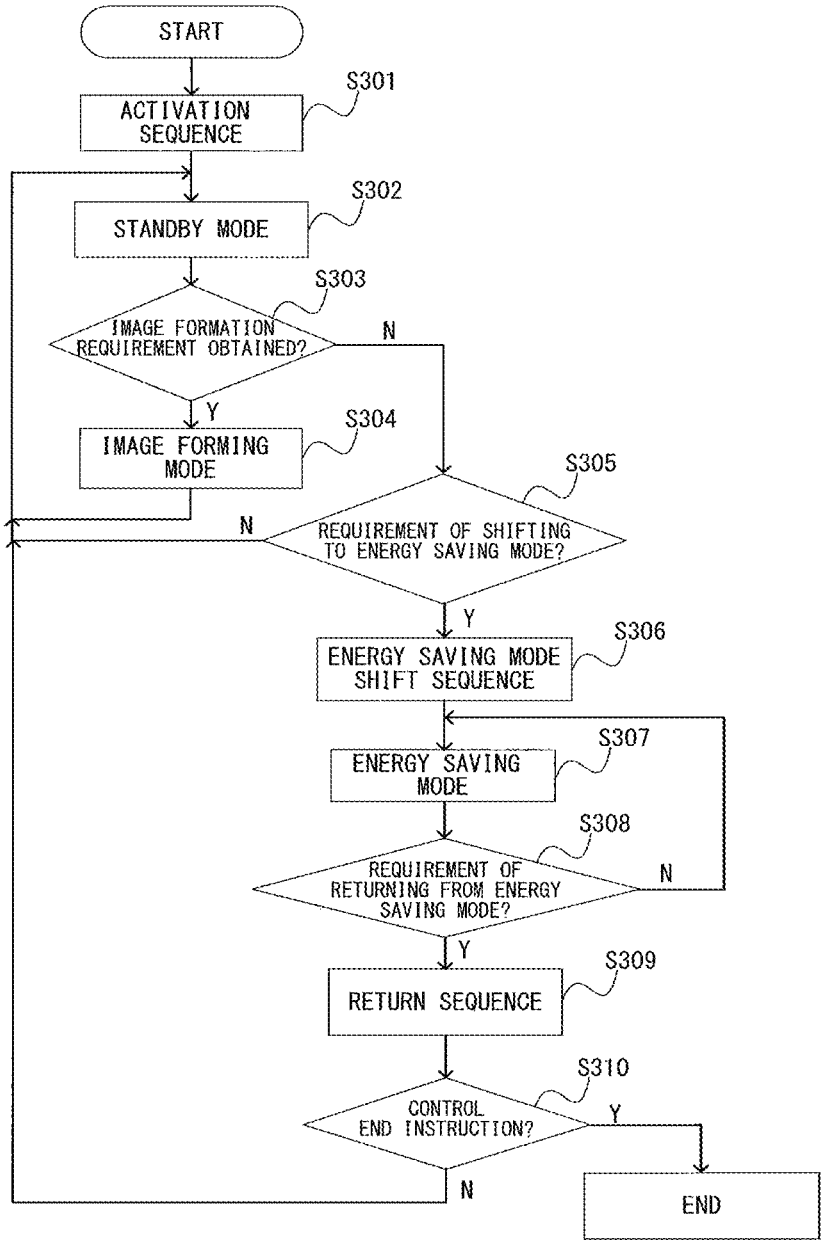
FIG. 3 is a control flow chart.

Next, referring to the control flow chart illustrated in FIG. 3, processing to be executed by the system controller 117 of the image forming apparatus 1 is schematically described. Unless particularly noted, the following processing is executed by the system controller 117 via the CPU 131.

When the AC commercial power supply starts feeding power to the image forming apparatus 1 via the AC cord 104, power is supplied from the control circuit DC power supply 201 to the system controller 117.

The CPU 131 of the system controller 117 executes an activation sequence for executing processing including activation of the load drive AC power supply 205, state confirmation of the image forming apparatus 1, and various adjustments (step S301), and transitions the state to the standby mode (step S302). After that, the CPU 131 determines whether or not there is an image formation requirement from an externally connected device or from the image reading unit 102 (step S303).

When there is an image formation requirement (yes (Y) in step S303), the CPU 131 performs the image forming operation (step S304), and shifts to the standby mode again. When there is no image formation requirement (no (N) in step S303), it is determined whether or not an energy saving mode shift requirement is input through depression of the mode switching switch 123, or the like (step S305).

When it is determined that there is no shift requirement (N in step S305), the CPU 131 executes step S302 again. When it is determined that there is a shift requirement (Y in step S305), the CPU 131 executes an energy saving mode shift sequence step S306) to transition the state to the energy saving mode (step S307). In the energy saving mode shift sequence, the operation of the second control circuit 203 is stopped, and the operation of the load drive AC power supply 205 is also stopped. The operations of the first control circuit 202 and the control circuit DC power supply 201 are continued even after entering the energy saving mode.

After that, the CPU 131 determines whether or not an energy saving mode return requirement is input through depression of the mode switching switch 123, or the like (step S308). When the energy saving mode return requirement is not input, the CPU 131 executes step S307 again. When the energy saving mode return requirement is input, the CPU 131 executes a sequence of returning from the energy saving mode to be described later (step S309), and shifts to the standby mode. Further, the CPU 131 determines whether or not a control end instruction is input (step S310), and, when there is a control end instruction (Y in step S310), the processing is ended. When there is no control end instruction (N in step S310), step S302 is executed again.

Referring to FIG. 1A and FIG. 2, when the plug of the AC cord 104 of the image forming apparatus 1 is connected to an AC commercial power supply outlet, the AC commercial power is supplied to the control circuit DC power supply 201. The control circuit DC power supply 201 supplies power to the system controller 117.

The system controller 117 includes the first control circuit 202 configured to operate during the normal power mode (standby mode and image forming mode) and during the energy saving mode, and the second control circuit 203 configured to operate during the normal power mode but not to operate during the energy saving mode. When a requirement signal for shifting to the energy saving mode or a requirement signal for returning from the energy saving mode is input from the mode switching switch 123, the system controller 117 performs the following operations via the CPU 131, depending on the input signal.

(1) Activation of the second control circuit 203 (at the time of returning from the energy saving mode) and stop control (at the time of returning to the energy saving mode).

(2) Activation of the load drive AC power supply 205 by driving the relay 204 (at the time of returning from the energy saving mode) and stop control (at the time of shifting to the energy saving mode).

(3) Power feeding to the heater 111*a* from the control circuit DC power supply 201 by driving the FET 207 (at the time of returning from the energy saving mode) and cut-off control (at the time of shifting to the energy saving mode).

(4) Power feeding to the heaters 111*b* and 111*c* from the AC commercial power supply by driving the FET 206 and driving the relay 224 (at the time of returning from the energy saving mode) and cut-off control (at the time of shifting to the energy saving mode).

As the requirement of returning from the energy saving mode and the requirement of shifting to the energy saving mode, in addition to the above-mentioned depression of the mode switching switch 123, there are an image formation requirement from an externally connected device, and the like.

In this embodiment, power feeding of Items (3) and (4) is possible only when the environment switch 122 is in an ON state. Further, even when the environment switch 122 is absent, the first control circuit may control the energization state to the heaters 111*a*, 111*b*, and 111*c*, serving as environment heaters, to thereby always set the environment heaters in a non-power feeding state.

The load drive AC power supply 205 is connected to drive loads necessary for the image reading operation and the image forming operation, detection elements, and the control unit configured to control those elements.

When the environment switch 122 is in an OFF state, power is not fed from the control circuit DC power supply 201 to the heater 111*a*. Further, power is fed from the AC cord 104 to the heaters 111*b* and 111*c* via the relay 224. The relay 224 is controlled by the first control circuit 202 via the FET 206, but power is not fed to the FET 206 when the environment switch 122 is in an OFF state. In this case, power is not fed to the heaters 111*b* and 111*c* via the relay 224.

Therefore, when the environment switch 122 is in an OFF state, power is not fed to any of the heaters 111*a*, 111*b*, and 111*c*.

Subsequently, with use of FIG. 4A to FIG. 4C, the temperature states in the heaters 111*a* and 111*b* are shown. The operation of the heater 111*c* is similar to the operation of the heater 111*b*, and hence, a description thereof is omitted. In this embodiment, the temperature control units 221 and 222 are provided in the heaters 111*b* and 111*c*, respectively, and a thermal reed switch is mounted as temperature control means.

The thermal reed switch is configured to enable energization to the heater 111*b* when the temperature measured by the temperature control unit 221 is a predetermined temperature (T2) or less, to thereby enable heating of the heater 111*b*. On the other hand, when the heater 111*b* is heated through energization such that the temperature measured by the temperature control unit 221 reaches a predetermined temperature (T1) that is greater than T2, power feeding to the heater 111*b* is cut off. After the power feeding is cut off, when the temperature measured by the temperature control unit 221 reaches T2, the CPU 131 feeds power to the heater 111*b* again. In general, the temperature difference between T1 and T2 is set to about 5° C., and is set to 5° C. also in this embodiment.

The amount of heat generated by the heater 111*b* varies depending on an input voltage Vin. When the resistance of the heater 111*b* is Rhb, the amount of heat generated by the heater is (Vin)2/Rhb.

Figure 4A:
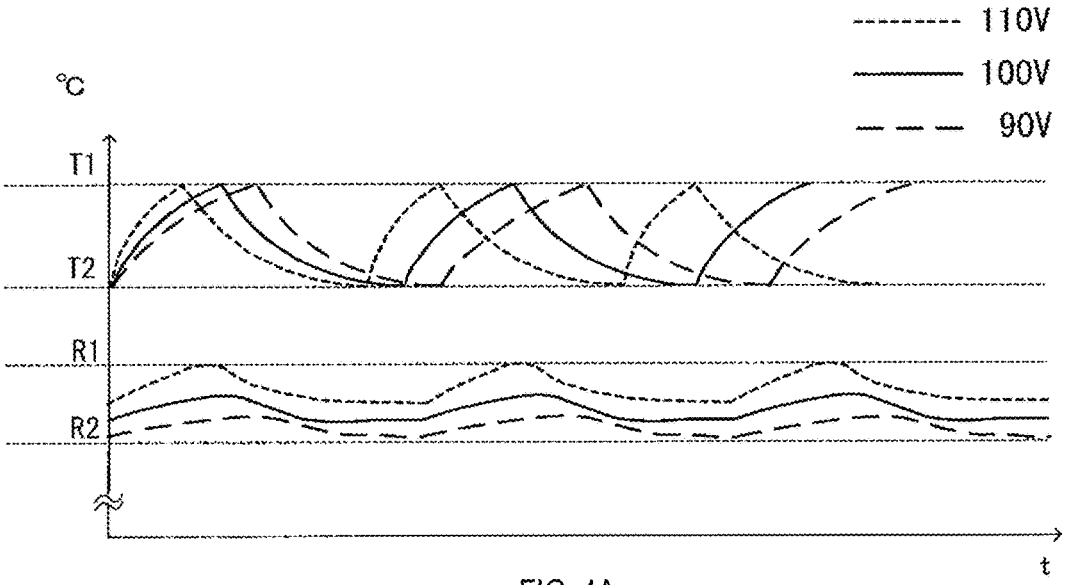
FIG. 4A is an explanatory graph of temperature ripples and states of a controlled element in each of an AC heater and a DC heater.

FIG. 4A is a graph for showing temperature transition of the heater 111*b* when the voltage input through the AC cord 104 is each of 90 V, 100 V, and 110 V, and temperature transition of atmosphere temperature of the image reading unit 102 being a unit in which the heater 111*b* is installed. In the following, the atmosphere temperature of the image reading unit 102, or the like, is simply referred to as temperature of the image reading unit 102, or the like. In FIG. 4A, the vertical axis represents temperature (° C.), and the lateral axis represents time (t).

The temperature transition of the heater 111*b* is represented by the three curves between T1 and T2. Further, the temperature of the image reading unit 102 heated by the heater 111*b* is represented by the three curves below T2. In FIG. 4A, the dotted line represents the temperature change at 110 V, the solid line represents the temperature change at 100 V, and the chain line represents the temperature change at 90 V. In the image reading unit, an allowable temperature range is determined to prevent the operation of the image forming apparatus 1 from being affected.

The temperature transition in each voltage is as represented in FIG. 4A, and the temperature of the heater 111*b* is controlled to be T2 or more and T1 or less in any of the voltages.

When 90 V is input as the voltage, the amount of heat generated by the heater 111*b* is reduced by about 20% with respect to the input at 100 V, and, when 110 V is input, the amount of heat generated by the heater 111*b* is increased by about 20% with respect to the input at 100 V. As represented by the three curves below T2 in FIG. 4A, the temperature of the image reading unit 102 is highest when the input voltage Vin is 110 V, and is lowest when the input voltage Vin is 90 V. The description above is similarly applicable to the heater 111*c* configured to be driven by an AC power supply.

The graph is shown with the maximum temperature and the minimum temperature in the three curves being R1 and R2, respectively. When the power supply voltage is from 90 V to 110 V, the temperature of the heater 111*b* provided in the image reading unit falls within a temperature range represented from R2 to R1 (within a first temperature range). As shown in FIG. 4A, this temperature range is from about 4° C. to about 5° C.

Further, in the heaters 111*b* and 111*c* using the AC power supply, when the power supply voltage is 110 V, the temperature variation range of the heaters 111*b* and 111*c* is increased as compared to the case in which the power supply voltage is 90 V. Further, when the AC power supply voltage to be supplied in the region in which the image forming apparatus 1 is arranged is from 90 V to 110 V, the temperature range of the atmosphere temperature inside the image reading unit 102 is from R1 to R2. When the image forming apparatus 1 is arranged in a region in which the AC power supply voltage to be supplied is smaller than 90 V or larger than 110 V, the first temperature range is further increased.

As described above, in the heaters 111*b* and 111*c* to be driven by the AC power supply, their average temperature, and the deviation from the target temperature (hereafter referred to as "temperature ripple") vary depending on the voltage variation of the AC commercial power supply. Therefore, it is difficult to perform stable temperature control.

In the image reading unit 102 and the sheet feeding cassette 124 in which the heater 111*b* and the heater 111*c* are installed, respectively, however, the generation of the temperature ripple and the change in average temperature less affect the performance as compared to the case of the image forming unit 125, and the like. Therefore, depending on the average voltage input to the image forming apparatus 1 (for example, 100 V, 120 V, and 240 V), an environment heater configured to generate substantially equal amount of heat (power consumption) may be installed.

Meanwhile, in the image forming unit 125 in which the heater 111*a* is arranged, parts that require precise temperature management are provided, such as the photosensitive drum and the developing device. In detail, when the temperature is increased, the toner may be aggregated, and hence, for example, the temperature of the image forming unit 125 is required to be maintained to be lower than 40° C. Therefore, the allowable temperature range of the image forming unit 125 is narrower than the allowable temperature range of the image reading unit 102 so as to prevent the operation of the image forming apparatus 1 from being affected. In order to stabilize the toner charging amount in the developing device, and to perform appropriate image formation while preventing the dew condensation, the temperature of the image forming unit 125 may be maintained to about 35° C.

The DC heater uses a DC power supply having a stable voltage, and hence, temperature adjustment control with fewer ripples is possible. Therefore, as the heater 111*a*, the DC heater is used. As the power supply for the heater 111*a*, there is used the control circuit DC power supply 201 capable of supplying DC power even in the energy saving mode.

The control circuit DC power supply 201 used in this embodiment can output DC power at an accuracy of 5 V±2% with use of AC power as an input. This accuracy is independent of the voltage variation of the input AC commercial power.

Figure 4B:
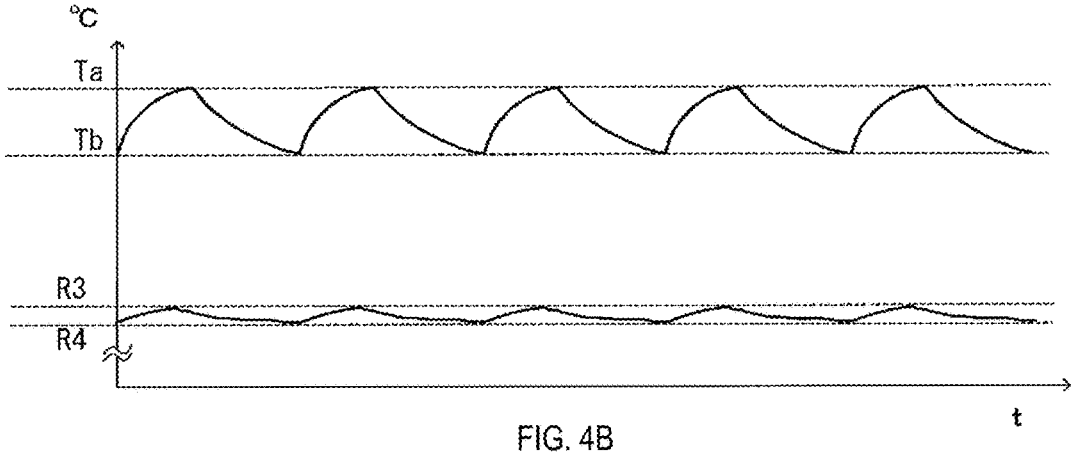
FIG. 4B is an explanatory graph of the temperature ripples and the states of the controlled element in each of the AC heater and the DC heater.
Figure 4C:
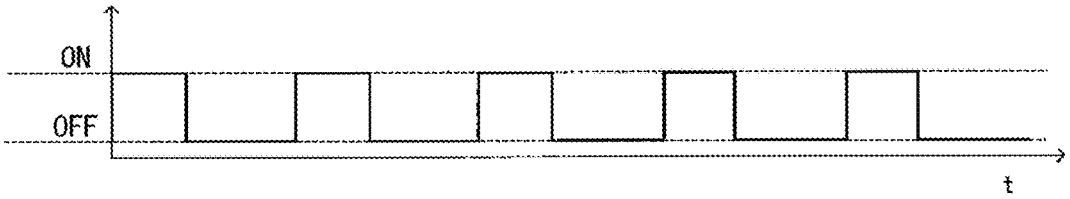
FIG. 4C is an explanatory graph of the temperature ripples and the states of the controlled element in each of the AC heater and the DC heater.

FIG. 4B is a graph for showing temperature transition of the heater 111*a*, and FIG. 4C is a graph for showing the state of the FET 207 whose OFF/ON state is to be controlled by the first control circuit 202, to be described later. In FIG. 4B, the vertical axis represents temperature (° C.), and the lateral axis represents time (t). In FIG. 4C, the vertical axis represents an ON/OFF state of the FET, and the lateral axis represents time (t).

As shown in FIG. 4B, the temperature of the heater 111*a* is controlled so as to be Tb or more and Ta or less. As shown in FIG. 4B, the temperature difference between Tb and Ta is set to be smaller than 5° C. that is the temperature difference between T2 and T1. In this embodiment, the temperature difference between Tb and Ta is set to 3° C.

Further, the graph is shown in FIG. 4B with the maximum atmosphere temperature and the minimum atmosphere temperature of the heater 111*a* provided in the image reading unit 102 being R3 and R4, respectively. The atmosphere temperature of the heater 111*a* represented by the curve below the temperature Tb of FIG. 4B falls within a temperature range represented from R3 to R4 (second temperature range). The heater 111*a* is fed power from the DC power supply, and as shown in FIG. 4B, the second temperature range represented from R3 to R4 is about 1° C. In other words, the second temperature range is narrower than the first temperature range of the heater 111*b* to be fed power from the AC power supply.

The amount of heat generated by the heater 111*a* is (Va)2/Rha, where Va represents a voltage of the control circuit DC power supply 201, and Rha represents a resistance value of the heater 111*a*. The voltage Va of the control circuit DC power supply 201 is independent of the voltage of the AC commercial power to be input to the power supply. Therefore, a stable amount of heat generation is secured. Therefore, the temperature ripples are small, and further the average temperature can be stabilized.

Figure 5A:
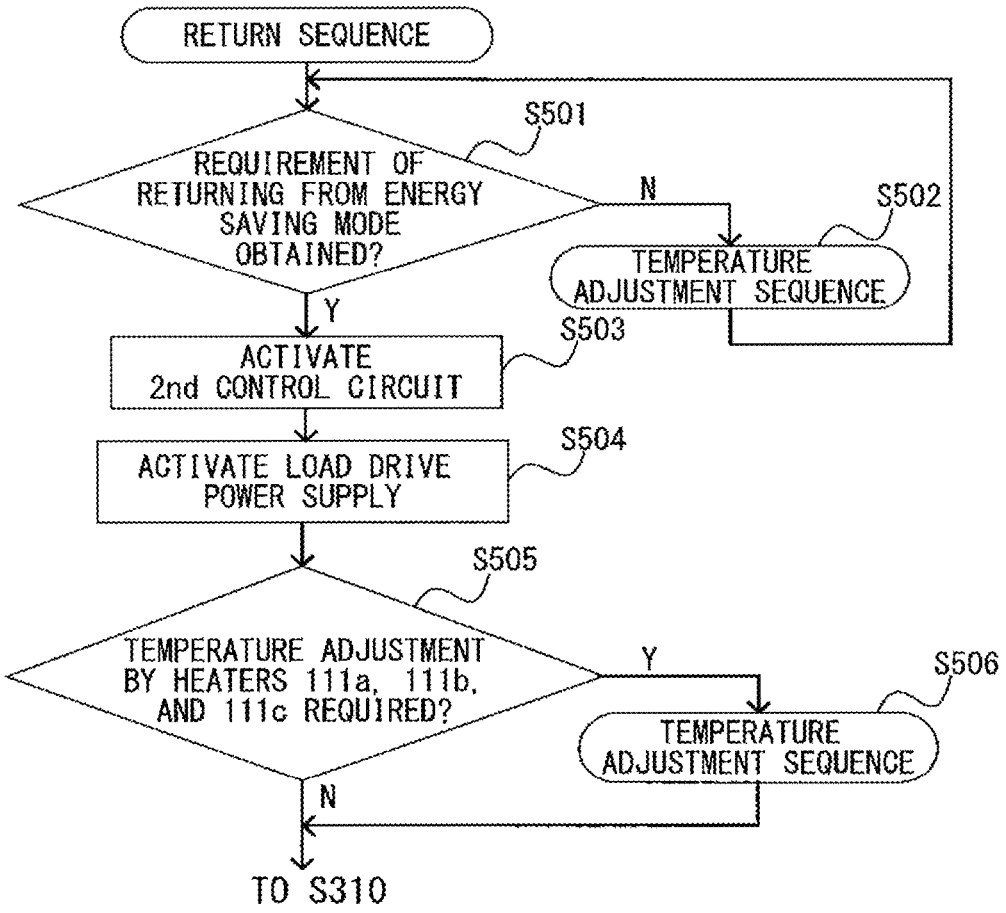
FIG. 5A is a flow chart for illustrating control during shift from an energy saving mode.
Figure 5B:
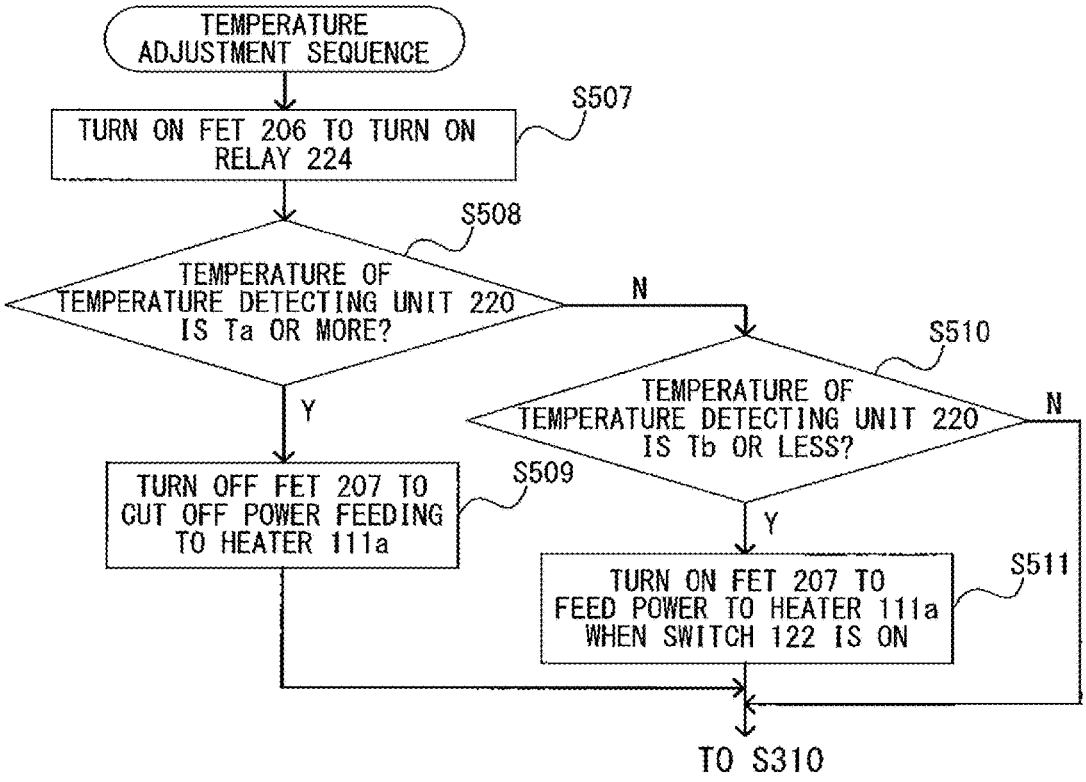
FIG. 5B is a flow chart for illustrating control during shift from the energy saving mode.

Next, with reference to flow charts illustrated in FIG. 5A and FIG. 5B, temperature control in the heater 111*a* is described. Each processing is executed by the CPU 131 unless particularly noted.

FIG. 5A is a flow chart for illustrating details of the processing of returning from the energy saving mode in step S309 of FIG. 3. When the determination result in step S308 of FIG. 3 is Y, the CPU 131 determines whether or not there is a requirement of returning to the normal mode from the energy saving mode, e.g., the requirement signal for returning from the energy saving mode (step S501). When there is no requirement of returning from the energy saving mode (N in step S501), the processing proceeds to a temperature adjustment sequence (step S502), and executes step S501 again.

When there is a requirement of returning from the energy saving mode (Y in step S501), the CPU 131 activates the second control circuit 203 to prepare for the image formation (step S503). After that, the CPU 131 turns on the relay 204 to drive the load drive AC power supply 205 (step S504), to thereby obtain a state in which the image forming operation is enabled. Subsequently, the CPU 131 determines whether or not the temperature adjustment by the heaters 111*a*, 111*b*, and 111*c* is necessary (step S505).

One purpose for operating the environment heater is to prevent occurrence of dew condensation. Therefore, in step S505, it is determined whether or not the image forming apparatus 1 is in a situation in which dew condensation occurs. In detail, when the environment of the image forming apparatus 1 is 20° C.±5° C., and the humidity is around 40%, the temperature adjustment by the environment heaters 111*b* and 111*c* is unnecessary.

When the CPU 131 determines that the temperature adjustment by the heaters 111*b* and 111*c* is unnecessary (N in step S505), the CPU 131 executes step S310 illustrated in FIG. 3. When the CPU 131 determines that the temperature adjustment by the heaters 111*b* and 111*c* is necessary (Y in step S505), the CPU 131 transfers to the temperature adjustment sequence illustrated in FIG. 5B (step S506). The CPU 131 determines whether or not temperature control is necessary based on the temperature and the humidity detected by the environment sensor 190.

As illustrated in FIG. 5B, in the temperature adjustment sequence, the CPU 131 turns on the FET 206. At this time, when the environment switch 122 is in an ON state, the relay 224 is turned on, to thereby energize the temperature control units 221 and 222 of the heaters 111*b* and 111*c*, respectively step S507). The temperature control units 221 and 222 control temperatures of the heaters 111*b* and 111*c*, respectively, so as to fall within a range between temperatures T1 and T2 as shown in FIG. 4A.

Subsequently, the CPU 131 determines whether or not the temperature detected by the temperature detecting unit 220 of the heater 111*a* is a predetermined temperature Ta or more (step S508). When the detected temperature is Ta or more (Y in step S508), the CPU 131 turns off the FET 207 to cut off the power feeding to the heater 111*a* (step S509), and then executes step S310 of FIG. 3.

When the temperature detected by the temperature detecting unit 220 is less than Ta (step S508), the CPU 131 determines whether or not the detected temperature is equal to or less than a predetermined temperature Tb, which is a temperature lower than Ta (step S510). When the detected temperature is Tb or less (Y in step S510), the CPU 131 turns on the FET 207 to allow power feeding (step S511). With this, when the environment switch 122 is in an ON state, the heater 111*a* is fed power to be heated, and the CPU 131 executes step S310 of FIG. 3.

On the other hand, when the detected temperature is more than Tb (N in step S510), the CPU 131 maintains the state of the FET 207, and executes step S310 of FIG. 3.

In the first embodiment, in the energy saving mode, the first control circuit 202 and the control circuit DC power supply 201 are operated, and the operations of the second control circuit 203 and the load drive AC power supply 205 are stopped. As described above, by stopping the operations of the second control circuit 203 and the load drive AC power supply 205, power consumption is suppressed in the energy saving mode.

Further, the heater 111*a* is provided in the image forming unit 125, which requires precise temperature management and has a narrow allowable temperature range. Therefore, a DC heater is used for the heater 111*a* to enable precise temperature management. On the other hand, the heaters 111*b* and 111*c* to be arranged in the image reading unit 102 and the sheet feeding cassette 124 are allowed to have a relatively larger temperature range, and hence, AC heaters to be driven by AC power are used for the heaters 111*b* and 111*c*.

As described above, the number of heaters to be driven by DC power during the energy saving mode is reduced. Thus, power consumption can be suppressed to be low.

Further, in the first embodiment, the temperature control of the heater 111*a* is executed by the first control circuit 202, and the temperature controls of the heaters 111*b* and 111*c* are executed by the temperature control units 221 and 222, respectively. In other words, the first control circuit 202 determines whether or not to perform power feeding to the heaters 111*b* and 111*c*, and the temperature control units 221 and 222 execute the temperature control.

Next, a second embodiment of the present invention is described. In the following description, a description of portions of the image forming apparatus 1 that are similar to those in the first embodiment is omitted.

Figure 6:
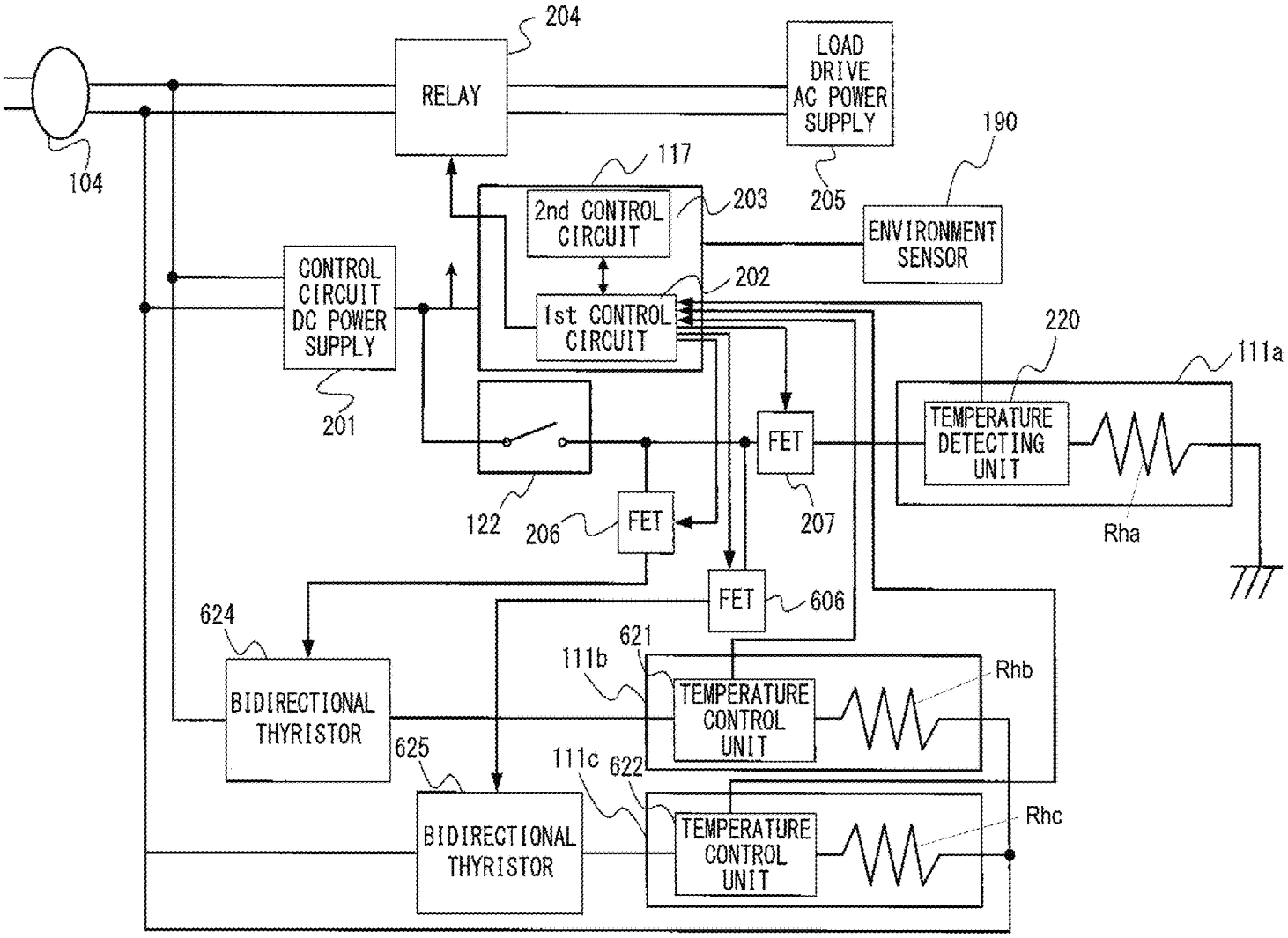
FIG. 6 is a function block diagram of an image forming apparatus.

FIG. 6 is a functional block diagram of an image forming apparatus 1 according to the second embodiment.

In the first embodiment, the first control circuit 202 is configured to control power feeding to the heater 111*b* and the heater 111*c* through the FET 206 and the relay 224.

In the second embodiment, as illustrated in FIG. 6, power feeding to the heater 111*b* is controlled through the FET 206 and a bidirectional thyristor 624. Further, power feeding to the heater 111*c* is controlled through an FET 606 and a bidirectional thyristor 625.

Therefore, in the second embodiment, power feeding to the heater 111*b* and power feeding to the heater 111*c* are controlled individually. Further, a temperature detecting unit 621 is provided to the heater 111*b*, and a temperature detecting unit 622 is provided to the heater 111*c*. Other configurations are similar to those of the image forming apparatus 1 illustrated in FIG. 2.

When the requirement signal for shifting to the energy saving mode or the requirement signal for returning from the energy saving mode is input from the mode switching switch 123, the system controller 117 performs the following operations depending on the input signal.

(1) Activation of the second control circuit 203 and stop control.

(2) Activation of the load drive AC power supply 205 by driving the relay 204 and stop control.

(3) Power feeding to the heater 111*a* from the control circuit DC power supply 201 by driving the FET 207 and cut-off control.

(4) Power feeding to the heater 111*b* from the AC commercial power supply by driving the FET 206 and driving the bidirectional thyristor 624, and cut-off control.

(5) Power feeding to the heater 111*c* from the AC commercial power supply by driving the FET 606 and driving the bidirectional thyristor 625, and cut-off control.

As the requirement of returning from the energy saving mode and the requirement of shifting to the energy saving mode, in addition to the above-mentioned depression of the mode switching switch 123, there are an image formation requirement from an externally connected device, and the like.

In this embodiment, as described above, power feeding of Items (3), (4), and (5) is possible only when the environment switch 122 is in an ON state. Further, even when the environment switch 122 is absent, the first control circuit 202 may control the energization state to the heaters 111*a*, 111*b*, and 111*c* serving as environment heaters, to thereby always set the environment heaters in a non-power feeding state.

The load drive AC power supply 205 is connected to drive loads necessary for the image reading operation and the image forming operation, detection elements, and the control unit configured to control those detection elements.

In the image forming apparatus of the second embodiment, when the environment switch 122 is in an OFF state, power is not fed from the control circuit DC power supply 201 to the heater 111*a*. Further, power is not fed to the bidirectional thyristor 624 or 625 configured to feed power to the heater 111*b* or 111*c*, and thus, those bidirectional thyristors 624 and 625 cannot be turned on. Therefore, when the environment switch 122 is in an OFF state, power feeding to the heaters 111*a*, 111*b*, and 111*c* serving as the environment heaters is cut off.

Similarly to the first embodiment, the image forming apparatus of the second embodiment executes the processing illustrated in the control flow chart of FIG. 3. Further, in step S309 of FIG. 3, similarly to the first embodiment, the sequence of returning from the energy saving mode illustrated in FIG. 5A is executed.

In the first embodiment, in step S506 of FIG. 5A, the temperature adjustment sequence illustrated in FIG. 5B is executed. In the second embodiment, after the control of FIG. 5B is performed, the temperature adjustment sequence illustrated in FIG. 7 is further executed.

Figure 7:
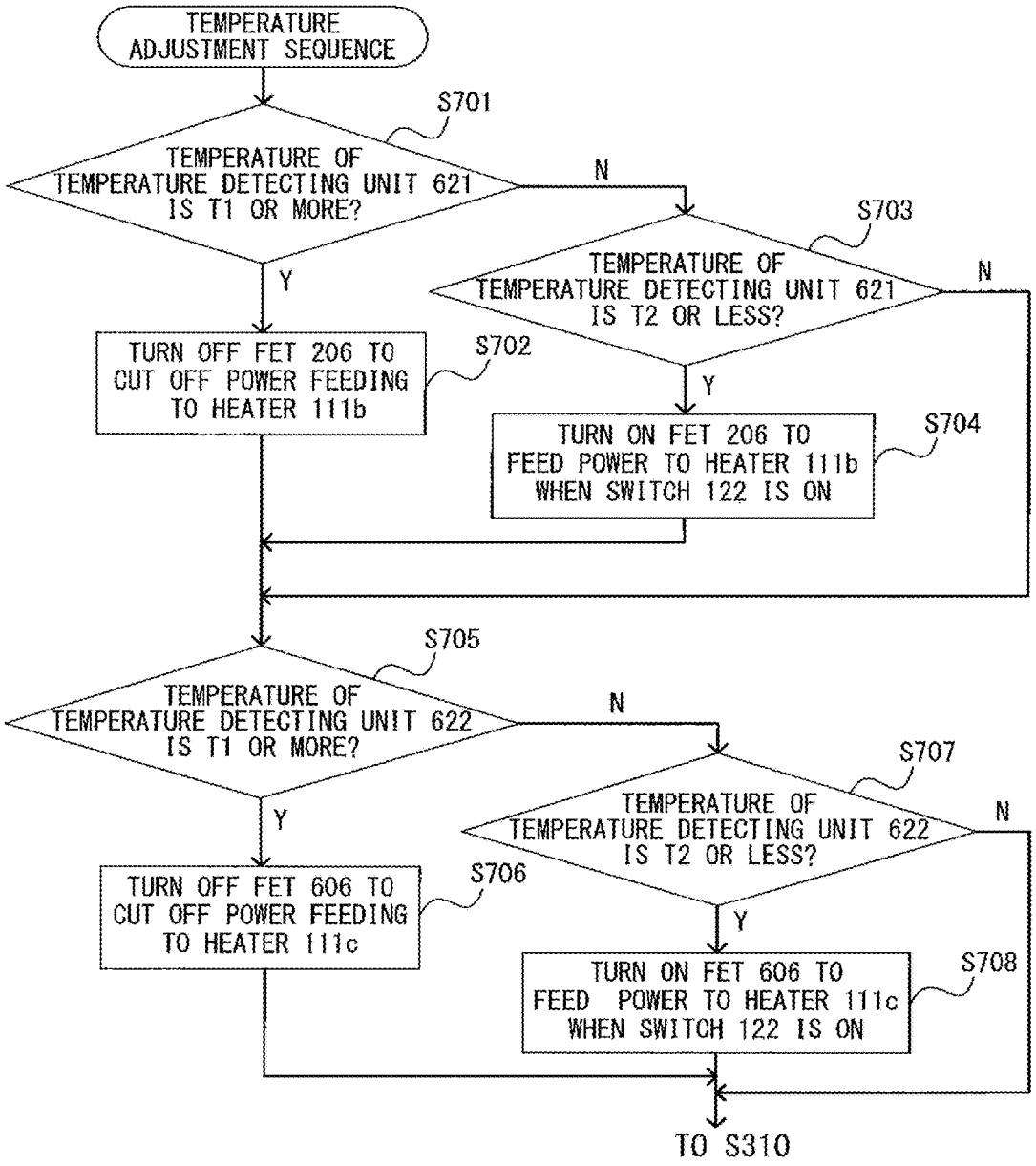
FIG. 7 is a flow chart for illustrating control during shift from the energy saving mode.

Now, with reference to the flow chart of FIG. 7, control for the heater 111*b* by the temperature adjustment sequence is described. Control for the heater 111*c* is similar to that for the heater 111*b*, and hence, a description thereof is omitted herein.

The CPU 131 determines whether or not the temperature detected by the temperature detecting unit 621 of the heater 111*b* is a predetermined temperature T1 or more (step S701). When the detected temperature is T1 or more (Y in step S701), the CPU 131 turns off the FET 206 to cut off power feeding from the control circuit DC power supply to the heater 111*b* (step S702), and executes step S705 to be described later.

When the temperature detected by the temperature detecting unit 621 is less than T1 (N in step S701), the CPU 131 determines whether or not the detected temperature is equal to or less than a predetermined temperature T2, which is a temperature lower than T1 (step S703). When the detected temperature is T2 or less (Y in step S703), the CPU 131 turns on the FET 206 to allow power feeding (step S704). With this, when the environment switch 122 is in an ON state, the heater 111*b* is fed power to be heated. After that, the CPU 131 executes step S705 to be described later. On the other hand, when the detected temperature is more than T2 (N in step S703), the CPU 131 maintains the state of the FET 206.

After that, the CPU 131 determines whether or not the temperature detected by the temperature detecting unit 622 of the heater 111*c* is the predetermined temperature T1 or more (step S705). When the detected temperature is T1 or more (Y in step S705), the CPU 131 turns off the FET 606 to cut off the power feeding from the control circuit DC power supply 201 to the heater 111*c* (step S706), and executes step S310 of FIG. 3.

When the temperature detected by the temperature detecting unit 622 is less than T1 (N in step S705), the CPU 131 determines whether or not the detected temperature is equal to or less than the predetermined temperature T2, which is a temperature lower than T1 (step S707). When the detected temperature is T2 or less (Y in step S707), the CPU 131 turns on the FET 606 to allow the power feeding (step S708). With this, when the environment switch 122 is in an ON state, the heater 111*c* is fed power to be heated. After that, the CPU 131 executes step S310 of FIG. 3. On the other hand, when the detected temperature is more than T2 (N in step S707), the CPU 131 maintains the state of the FET 606 to execute step S310 of FIG. 3.

In the second embodiment, similarly to the first embodiment, by stopping the operations of the second control circuit 203 and the load drive AC power supply 205 in the energy saving mode, the power consumption is suppressed. Further, the heater 111*a* is provided in the image forming unit 125, which requires precise temperature management and has a narrow allowable temperature range. Therefore, a DC heater is used for the heater 111*a* to enable precise temperature management. On the other hand, the heaters 111*b* and 111*c* to be arranged in the image reading unit 102 and the sheet feeding cassette 124 are allowed to have a relatively larger temperature range, and hence, AC heaters to be driven by AC commercial power are used for the heaters 111*b* and 111*c*.

As described above, in the second embodiment, the number of heaters to be driven by DC power during the energy saving mode is reduced. Thus, power consumption can be suppressed to be low.

Further, in the second embodiment, the temperature of the heater 111*b* is controlled depending on the temperature detected by the temperature detecting unit 621, and the temperature of the heater 111*c* is controlled depending on the temperature detected by the temperature detecting unit 622.

Therefore, the CPU 131 individually controls the temperatures of the heaters 111*b* and 111*c*. As a result, unlike the first embodiment, the temperature control unit is not required to be individually provided to the heaters 111*b* and 111*c*.

As described above, according to the present invention, the AC heater is used in a portion in which the temperature ripple is allowed to some extent, and the DC heater is used in a portion in which it is required to suppress the temperature ripple to be low.

In particular, in the image forming apparatus, as problems that may arise due to the temperature ripple, there are given toner aggregation due to excessive temperature rise, image defects due to non-achievement of the target temperature to cause destabilization of charges of toner inside the developing device, and the like. Therefore, in portions in which the temperature ripple is allowed to some extent, such as the image reading unit and the sheet feeding cassette unit, the AC heater is used. On the other hand, in portions in which it is required to suppress the temperature ripple to be low, e.g., the image forming unit including the photosensitive drum and the developing device, the DC heater is used.

In this manner, even when a plurality of environment heaters is installed, the increase in output of the control circuit DC power supply can be suppressed while achieving appropriate temperature control.

The above-mentioned embodiments are presented for describing the present invention more specifically, and the scope of the present invention is not limited to those embodiments.

For example, in the above-mentioned embodiments, the CPU 131 is configured to control the first control circuit 202 and the second control circuit 203 illustrated in FIG. 2. A CPU provided in the control circuit 202 or the control circuit 203 may, however, be used as the CPU 131.

Further, in the second embodiment, after the control of FIG. 5B is performed, the temperature adjustment sequence illustrated in FIG. 7 is further executed. After the control of FIG. 7 is performed, however, the control of FIG. 5A may be performed.

The invention claimed is:

1. An image forming apparatus comprising:

a sheet feeding cassette configured to store a recording sheet;

a conveyance unit configured to convey the recording sheet stored in the sheet feeding cassette;

an image forming unit configured to form an image on a photo sensitive member, and to transfer the image onto the recording sheet conveyed by the conveyance unit;

a power supply unit configured to convert an alternating current (AC) voltage of a commercial power supply into a direct current (DC) voltage, and configured to supply the AC voltage and the DC voltage;

a first heater configured to heat the sheet feeding cassette, and to generate heat with the AC voltage supplied by the commercial power supply; and a second heater configured to heat the photosensitive member of the image forming unit, and to generate heat with the DC voltage supplied by the power supply unit.

2. The image forming apparatus according to claim 1, wherein the image forming apparatus is configured to operate in a standby mode, in which power is supplied to the image forming unit, and a power saving mode, in which power supply to the image forming unit is stopped, wherein, in the standby mode, power supply to each of the first heater and the second heater is stopped, and wherein, in the power saving mode, power is supplied to each of the first heater and the second heater.

3. The image forming apparatus according to claim 2, further comprising a control unit configured to control power supply of the power supply unit, wherein the control unit is configured to control the power supply unit such that:

when the control unit shifts from the standby mode to the power saving mode, the power supply to the image forming unit is stopped and power is supplied to the second heater; and when the control unit shifts from the power saving mode to the standby mode, the power supply to the second heater is stopped and power is supplied to the image forming unit.

4. The image forming apparatus according to claim 1, further comprising means configured to control a voltage to be supplied to the second heater based on temperature information acquired from a temperature detecting unit provided in the second heater.

5. The image forming apparatus according to claim 1, further comprising a switch capable of switching between feeding of power and cutting-off of power to each of the first heater and the second heater through a manual operation.

6. An image forming apparatus comprising:

an image reading unit configured to read an original to generate image data;

an image forming unit configured to form an image on a photosensitive member based on the image data generated by the image reading unit;

a power supply unit configured to convert an alternating current (AC) voltage of a commercial power supply into a direct current (DC) voltage, and configured to supply the AC voltage and the DC voltage;

a first heater configured to heat the image reading unit, and to generate heat with the AC voltage of the commercial power supply; and a second heater configured to heat the photosensitive member of the image forming unit, and to generate heat with the DC voltage of the power supply unit.

7. The image forming apparatus according to claim 6, wherein the image forming apparatus is configured to operate in a standby mode, in which power is supplied to the image forming unit, and a power saving mode, in which power supply to the image forming unit is stopped, wherein, in the standby mode, power supply to each of the first heater and the second heater is stopped, and wherein, in the power saving mode, the power supply to each of the first heater and the second heater is stopped.

8. The image forming apparatus according to claim 7, further comprising a control unit configured to control power supply of the power supply unit, wherein the control unit is configured to control the power supply unit such that:

when the control unit shifts from the standby mode to the power saving mode, the power supply to the image forming unit is stopped and power is supplied to the second heater; and when the control unit shifts from the power saving mode to the standby mode, the power supply to the second heater is stopped and power is supplied to the image forming unit.

9. The image forming apparatus according to claim 8, further comprising means configured to control a voltage to be applied to the second heater based on temperature information acquired from a temperature detecting unit included in the second heater.

10. The image forming apparatus according to claim 6, further comprising a switch capable of switching between feeding of power and cutting-off of power to each of the first heater and the second heater through a manual operation.

11. An image forming apparatus, comprising:

a first unit allowed to have a first temperature range;

a second unit allowed to have a second temperature range, which is an allowable temperature range narrower than the first temperature range;

a power supply unit configured to convert an alternating current (AC) voltage of a commercial power supply into a direct current (DC) voltage, and configured to supply the AC voltage and the DC voltage;

a first heater arranged in the first unit and configured to receive power from the AC voltage supplied by the power supply unit, the first heater being configured to be controlled such that a temperature of the first unit falls within the first temperature range; and a second heater arranged in the second unit and configured to receive power from the DC voltage supplied by the power supply unit, the second heater being configured to be controlled such that a temperature of the second unit falls within the second temperature range.

12. The image forming apparatus according to claim 11, wherein the first unit comprises one of a sheet feeding cassette and an image reading unit.

13. The image forming apparatus according to claim 11, wherein the second unit comprises an image forming unit.

14. The image forming apparatus according to claim 11, further comprising a switch unit configured to manually switch between a state in which power supply to the first heater and power supply to the second heater are both cut off, and a state in which the power supply to the first heater and the power supply to the second heater are both allowed.

15. The image forming apparatus according to claim 11, further comprising:

cut-off means configured to cut off power to be supplied from the commercial power supply to a load to be driven by the AC voltage of the commercial power supply; and control means configured to control the cut-off means to cut off the power, and capable of executing a first mode of allowing power supply to each of the first heater and the second heater, and a second mode of allowing both of power from the AC voltage to a load to be driven by the AC voltage and the power supply to each of the first heater and the second heater.

16. The image forming apparatus according to claim 15, further comprising mode switching means configured to receive a requirement of shifting to the first mode, wherein the control means is further configured to execute the first mode based on receipt of the requirement of shifting to the first mode by the mode switching means.

17. The image forming apparatus according to claim 15, wherein the control means is provided in the first unit and is further configured to control the first heater such that the temperature of the first unit falls within the first temperature range.

18. The image forming apparatus according to claim 15, wherein the control means is further configured to control the first heater such that the temperature of the first unit falls within the first temperature range, and to control the second heater such that the temperature of the second unit falls within the second temperature range.

* * * * *